US006240265B1

(12) United States Patent
Noh

(10) Patent No.: US 6,240,265 B1
(45) Date of Patent: May 29, 2001

(54) FIXING DEVICE HEAT SHIELD AND METHOD FOR FORMING A HEAT SHIELD IN A PRINTER

(75) Inventor: Joo-Hwan Noh, Taegukwangyok-shi (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/467,012

(22) Filed: Dec. 20, 1999

(30) Foreign Application Priority Data

Dec. 30, 1998 (KR) ..... 98/60925

(51) Int. Cl.[7] ..... G03G 21/20
(52) U.S. Cl. ..... 399/92; 399/94
(58) Field of Search ..... 399/91, 92, 93, 399/94

(56) References Cited

U.S. PATENT DOCUMENTS 4,427,285 1/1984 Stange .
4,847,636 7/1989 Durbeck et al. .
5,113,220 5/1992 Kwak .
5,166,728 * 11/1992 Nagaoka et al. ..... 399/91
5,266,999 11/1993 Yashiro .
5,469,242 11/1995 Yu et al. .
5,471,280 * 11/1995 Taguchi ..... 399/93 X
5,589,918 12/1996 Oshida et al. .
5,794,102 8/1998 Coffey et al. .
6,075,956 * 6/2000 Watanabe et al. ..... 399/92
6,151,466 * 11/2000 Fujiwara ..... 399/92

* cited by examiner

*Primary Examiner*—William J. Royer
(74) *Attorney, Agent, or Firm*—Robert E. Bushnell, Esq.

(57) ABSTRACT

There is provided a fixing device heat shield apparatus in a printer having a fixing device and a developing device. A plurality of air holes are formed on a side surface of a body frame of the printer over the fixing device, for discharging heated air to the outside of the printer, and a heat shielding plate is located between the fixing device and the developing device, for blocking heat transfer from the fixing device.

48 Claims, 6 Drawing Sheets

FIXING DEVICE HEAT SHIELD AND METHOD FOR FORMING A HEAT SHIELD IN A PRINTER

CLAIM OF PRIORITY

This application makes reference to, incorporates the same herein, and claims all benefits accruing under 35 U.S.C. §119 from an application entitled FIXING HEAT SHIELD DEVICE IN PRINTER earlier filed in the Korean Industrial Property Office on Dec. 30, 1998, and there duly assigned Ser. No. 98-60925.

BACKGROUND OF THE INVENTION

1. Field of the Invention

The present invention relates to a device for protecting internal devices of a laser beam printer (LBP) against heat emitted from a fixing device in a laser beam printer (LBP), and in particular, to a device for discharging fixing heat from the fixing device to the outside of a laser beam printer (LBP) to prevent heat transfer from a fixing device to other internal devices of the laser beam printer (LBP).

2. Description of the Related Art

A laser beam printer (LBP) exemplary of contemporary practice in the art includes a paper feeder for feeding a sheet of paper, a developing device for forming an image onto the paper sheet fed from the paper feeder, a fixing device for fixing the image on the paper sheet, and a discharging device for discharging the paper having thereon the fixed image. The paper feeder includes a pick-up roller located at an appropriate position of a printer body, for feeding a plurality of paper sheets loaded on a paper cassette, sheet by sheet, and a register roller for aligning the leading end of a paper sheet fed by the pick-up roller.

In the developing device, an organic photoconductive (OPC) drum is rotatably installed to produce an electrostatic latent image corresponding to a digital image signal received from a laser scanner located in the body of the laser beam printer (LBP). In contact with the organic photoconductive (OPC) drum are a charge roller for charging the organic photoconductive (OPC) drum with a high voltage before exposure, a transfer roller for forming an image on a paper sheet, and a developing roller for developing the electrostatic latent image to form a toner image on the organic photoconductive (OPC) drum. A supply roller rotates in contact with the developing roller, for supplying toner from a toner hopper to the developing roller. The toner is frictionally charged by rotating the developing roller and the supply roller in the same direction and is supplied to the developing roller. A doctor blade is located above the developing roller with an end thereof fixed to a frame and the other end thereof directed downward to be in contact with the developing roller, for regulating the thickness of a toner layer coated on the developing roller.

In the fixing device, a pressure roller and a heat roller are rotated in contact with each other, respectively to fix a toner image on the paper sheet with a predetermined pressing force and melt toner particles on the paper sheet. The heat roller includes a heat lamp to fix the toner image at about 180° C.

A body frame and other internal devices of the laser beam printer (LBP) as described above are susceptible to damage due to a high temperature around the fixing device. In particular, when an excess of the heat is transferred to the developing unit, the toner powder is likely to be melted into a liquid or hardened. To overcome these problems, a ventilation fan is installed in a ventilation hole on a side surface of the body frame over the fixing device, to exhaust heated air stagnated in the fixing device to the outside or cool the fixing device. However, since the fixing device should be maintained at a specified temperature once the laser beam printer (LBP) has turned on, even if a printing operation is not performed, the ventilation fan should continue its action. As a result, power consumption is increased and the operational noise of the ventilation fan is generated.

U.S. Pat. No. 4,427,285 to Stange entitled Direct Duplex Printing On Pre-Cut Copy Sheets, discloses a two photoreceptor, single pass duplex reproduction system having a heat insulating prefuser transport device and first and second transfer stations. In particular, the prefuser transport is a pair of cold, toner compacting rolls adjacent the second transfer station for immediate pick up of a copy sheet supporting unfused images on both sides. The compacting rolls tack the unfused images to the copy sheet. It is disclosed the compacting rolls also insulate the photoreceptor from the heat of the fuser and convey the copy sheet immediately to the fuser. The fuser permanently fixes the images onto the copy sheet in one fuser operation.

U.S. Pat. No. 4,847,636 to Durbeck, et al. entitled Thermal Drop-On-Demand Ink Jet Print Head, disclose a thermal drop-on-demand ink jet print head in which thermal cross-talk problems are eliminated by providing heat shield members in the space between each of the heater elements. The heat shield members include metal fingers attached to either the common heater electrode or one of the control electrodes. It is disclosed the heat shield members enhance flow of heat into the substrate to thereby minimize thermal cross-talk among adjacent channels.

U.S. Pat. No. 5,113,220 to Kwak entitled Drum Cartridge For Electrophotographic Apparatus With Two-Piece Protected Shutter Covering The Drum, discloses a drum cartridge with a protective cover for an electrophotographic apparatus. The protective cover consists of upper and lower covers separately formed from each other, and the upper cover is operable to be opened and closed by a first gear pivoting around a drum shaft of a photosensitive drum. The lower cover is operable to be opened and closed by a connecting rod coupled to a second gear in mesh with the first gear, and has a driving pin driven by external force. According to the construction, the protective cover is automatically opened and closed by mounting and separating the drum cartridge, and capable of making the exposed area of a photosensitive drum be wide in an open position and protecting the photosensitive drum in a closed position.

U.S. Pat. No. 5,266,999 to Yashiro entitled Process Cartridge And Image Forming Apparatus For Use With The Same, discloses a process cartridge removably mountable within an image forming system including an image bearing member, process means acting on the image bearing member, a protection member shiftable between a protection position where the protection member protects the image bearing member and a retracted position where the protection member is retracted from the protection position, and abutment means formed on a surface of the protection member which can face the image bearing member, wherein the abutment means is adapted to be abutted against a non-image forming area of the image bearing member.

U.S. Pat. No. 5,469,242 to Yu, et al. entitled Corona Generating Device Having A Heated Shield, disclose a corona generating device of the type having a conductive shield partially surrounding a corona discharge electrode that is provided with a heating element. It is disclosed the heating element raises the surface temperature of the conductive shield to reduce or eliminate the adsorption of corona effluents and thereby minimize or prevent copy quality defects.

U.S. Pat. No. 5,589,918 to Oshida, et al. entitled Process Cartridge, Assembling Method Therefor And Electrophotographic Apparatus, disclose a process cartridge detachably mountable to an image forming apparatus, wherein the image forming apparatus light emitting means and light receiving means cooperative with the light emitting means to detect the amount of toner in a part of the process cartridge. The process cartridge includes an electrophotographic photosensitive member; process means actable on the electrophotographic photosensitive member; a toner container, adapted for being mounted in the part, for containing the toner to be used for developing a latent image formed in the electrophotographic photosensitive member; a light transmitting member, provided in the toner container, for transmitting light emitted form the light emitting means to permit detection of the amount of the toner in the toner container when the process cartridge is mounted to a main assembly of the image forming apparatus; a cover member movable between a protecting position for protecting the electrophotographic photosensitive member and a retracted position wherein the cover is retracted from the covering position, wherein upon movement of the cover member from the protecting position to the retracted position when the process cartridge is mounted to the main assembly, the cover member is retracted toward the toner container beyond a position of the light transmitting member.

U.S. Pat. No. 5,794,102 to Coffey, et al. entitled Toner Cartridge With Heat Shield Shutter, disclose a toner cartridge having a single molded element, molded of polystyrene, which is heat sensitive. The molded element forms front handles and a cleaner chamber mounts a photoconductor drum. A toner hopper is located generally under the handles. A developer roller receives toner from the hopper and applies it to the photoconductor drum. A lower shutter of polycarbonate, which is heat resistant, is mounted on actuating links. It is disclosed when the cartridge is installed in the printer the actuating links are moved to rotate the shutter to a position covering the lower surface of the cleaner chamber, where it serves as an effective heat shield protecting the cleaner from fixing heat of the printer.

SUMMARY OF THE INVENTION

An object of the present invention is, accordingly, to provide a heat shield device for protecting internal devices of the printer against heat from a fixing device in a printer.

Another object of the present invention is to provide a heat shield device in a printer, which can protect internal devices against heat from a fixing device in a printer, reduce power dissipation, and prevent operational noise.

To achieve the above and other objects of the present invention, there is provided a fixing device heat shield apparatus in a printer having a fixing device and a developing device. A plurality of air holes are formed on a side surface of a body frame of the printer over the fixing device, for discharging heated air to the outside of the printer, and a heat shielding plate is located between the fixing device and the developing device, for blocking heat transfer from the fixing device.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Preferred embodiments of the present invention will be described in detail with reference to the drawings.

Figure 1:
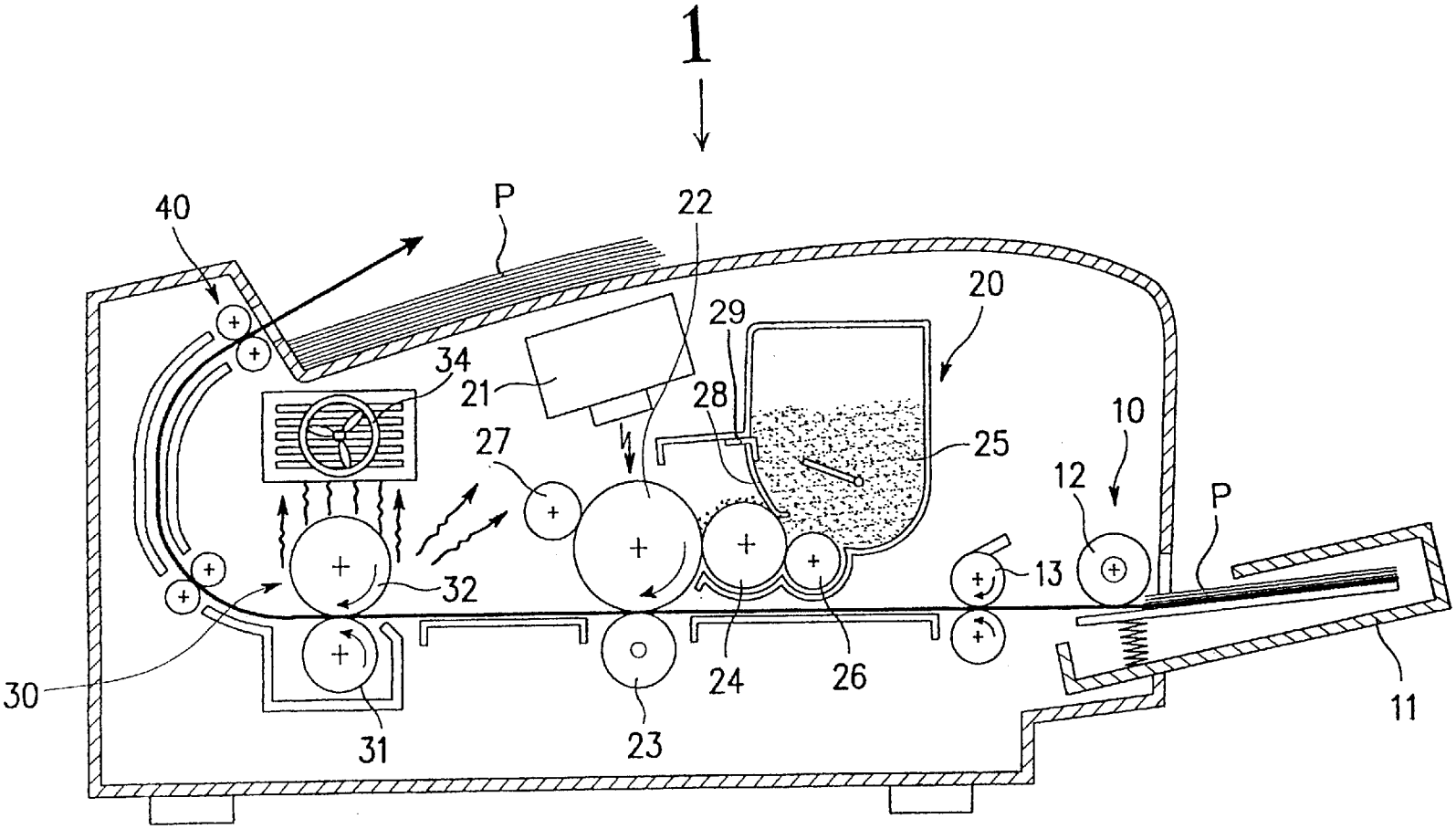
Fig. 1 (Prior Art)
FIG. 1 is a schematic view of a laser beam printer (LBP) exemplary of contemporary practice in the art.

FIG. 1 is a schematic view of a laser beam printer (LBP) 1 exemplary of contemporary practice in the art. Referring to FIG. 1, a printing operation in the laser beam printer (LBP) 1 will be described. The laser beam printer (LBP) includes a paper feeder 10 for feeding a paper sheet or a sheet of paper P, a developing device 20 for forming an image onto the paper sheet fed from the paper feeder 10, a fixing device 30 for fixing the image on the paper sheet, and a discharging device 40 for discharging the sheet of paper P having thereon the fixed image. The paper feeder 10 includes a pick-up roller 12 located at an appropriate position of a printer body, for feeding a plurality of paper sheets loaded on a paper cassette 11 sheet by sheet, and a register roller 13 for aligning the leading end of a paper sheet fed by the pick-up roller 12.

In the developing device 20, an organic photoconductive (OPC) drum 22 is rotatably installed to produce an electrostatic latent image corresponding to a digital image signal received from a laser scanner 21 located in the body of the laser beam printer (LBP) 1. In contact with the organic photoconductive (OPC) drum 22 are rotated a charge roller 27 for charging the organic photoconductive (OPC) drum 22 with a high voltage before exposure, a transfer roller 23 for forming an image on a paper sheet P, and a developing roller 24 for developing the electrostatic latent image to form a toner image on the organic photoconductive (OPC) drum 22. A supply roller 26 rotates in contact with the developing roller 24, for supplying toner from a toner hopper 25 to the developing roller 24. The toner is frictionally charged by rotating the developing roller 24 and the supply roller 26 in the same direction and is supplied to the developing roller 24. A doctor blade 28 is located above the developing roller 24 with an end thereof fixed to a frame 29 and the other end thereof directed downward to be in contact with the developing roller 24, for regulating the thickness of a toner layer coated on the developing roller 24.

In the fixing device 30, a pressure roller 31 and a heat roller 32 are rotated in contact with each other, respectively to fix a toner image on the paper sheet P with a predetermined pressing force and melt toner particles on the paper sheet P. The heat roller 32 includes a heat lamp to fix the toner image at about 180° C.

A body frame and other internal devices of the laser beam printer (LBP) as described above are susceptible to damage due to a high temperature around the fixing device 30. In particular, when an excess of the heat is transferred to the developing device 20, the toner powder is likely to be melted into a liquid or hardened. To overcome these problems, a ventilation fan 34 is installed in a ventilation hole on a side surface of the body frame over the fixing device 30, to exhaust heated air stagnated in the fixing device 30 to the outside of the laser beam printer (LBP) 1 or cool the fixing device 30. However, since the fixing device 30 should be maintained at a specified temperature once the laser beam printer (LBP) has turned on, even if a printing operation is not performed, the ventilation fan 34 should continue its action. As a result, power consumption is increased and the operational noise of the ventilation fan 34 is generated.

Figure 2:
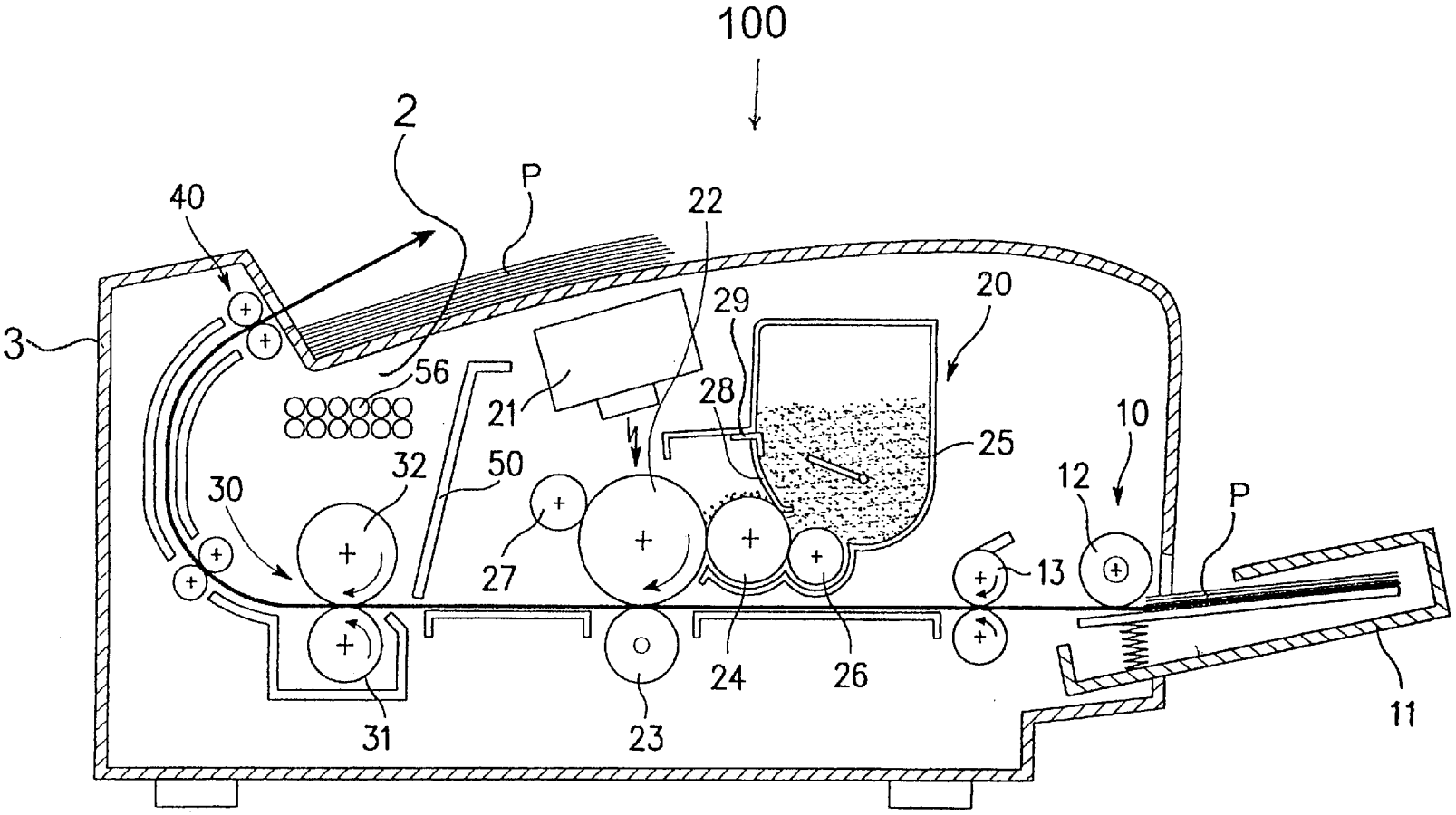
FIG. 2 is a schematic view of a laser beam printer (LBP) having a fixing device heat shield apparatus according to an embodiment of the present invention.

Referring now to FIG. 2 is a schematic view of a laser beam printer (LBP) 100 having a fixing device heat shield apparatus according to an embodiment of the present invention. Referring to FIG. 2, the laser beam printer (LBP) 100 according to the present invention is similar to a laser beam printer (LBP) exemplary of contemporary practice in the art in that it includes the printing medium feeder or paper feeder 10 for feeding a printing medium, such as a paper sheet P, the developing device 20 for forming an image onto the printing medium, such as the paper sheet P, fed from the printing medium feeder or paper feeder 10, the fixing device 30 for fixing the image on the printing medium or paper sheet P, and the discharging device 40 for discharging the printing medium or paper sheet P having the fixed image thereon.

Continuing with the reference to the laser beam printer (LBP) 100 in FIG. 2, the printing medium or paper feeder 10 in FIG. 2 includes a pick-up roller 12 at an appropriate position of a printer body, for feeding a plurality of printing medium or paper sheets loaded on a printing medium cassette or paper cassette 11 sheet by sheet, and a register roller 13 for aligning the leading end of a printing medium, such as a paper sheet P, fed by the pick-up roller 12.

In the developing device 20 of FIG. 2, an organic photoconductive (OPC) drum 22 is rotatably installed to produce an electrostatic latent image corresponding to a digital image signal received from a laser scanner 21 located in the body of the laser beam printer (LBP) 100. In contact with the organic photoconductive (OPC) drum 22 are rotated a charge roller 27 for charging the OPC drum 22 with a high voltage before exposure, a transfer roller 23 for forming an image on the printing medium, such as a paper sheet P, and a developing roller 24 for developing the electrostatic latent image to form a toner image on the organic photoconductive (OPC) drum 22. A supply roller 26 rotates in contact with the developing roller 24, for supplying toner from a toner hopper 25 to the developing roller 24. The toner is frictionally charged by rotating the developing roller 24 and the supply roller 26 in the same direction and supplied to the developing roller 24. A doctor blade 28 is located above the developing roller 24 with an end thereof fixed to a frame 29 and the other end thereof directed downward to be in contact with the developing roller 24, for regulating the thickness of a toner layer coated on the developing roller 24.

In the fixing device 30 of FIG. 2, a pressure roller 31 and a heat roller 32 are rotated in contact with each other, respectively to fix a toner image on the printing medium, such as the paper sheet P, with a predetermined pressing force and melt toner particles on the printing medium or paper sheet P. The heat roller 32 includes a heat lamp to fix the toner image at about 180° C., for example.

In FIG. 2, the ventilation fan 34 of FIG. 1 for cooling the fixing device is replaced in the fixing device heat shield apparatus of FIG. 2 by a plurality of air holes 56 and a heat shielding plate 50 is located between the fixing device 30 and the developing device 20, to prevent heat transfer from the fixing device 30 to the developing device 20.

The air holes 56 are desirably formed on a side surface 2 of the body frame 3 of the laser beam printer (LBP) 100 over the fixing device 30 to exhaust air heated in the fixing device 30 to the outside of the laser beam printer (LBP) printer 100. The heat shielding plate 50 is formed of an appropriate heat blocking material and completely isolates the fixing device 30 from the developing device 20. The structure and function of the heat shielding plate 50 will be described in detail referring to FIGS. 3A, 3B and 3C.

Figure 3A:
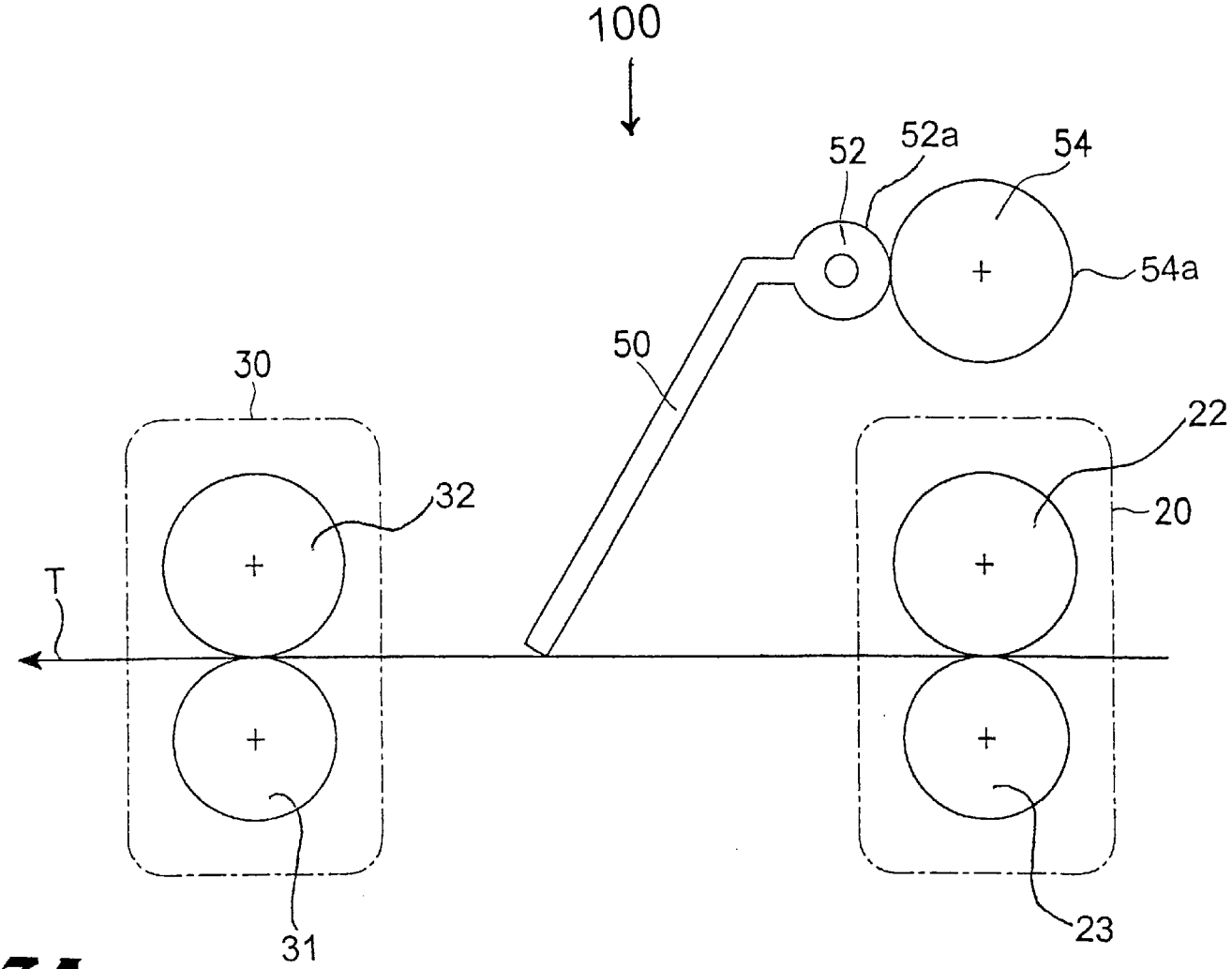
FIGS. 3A, 3B and 3C are schematic views of the fixing device heat shield apparatus according to the embodiment of FIG. 2 of the present invention, referred to for describing its operation.
Figure 3B:
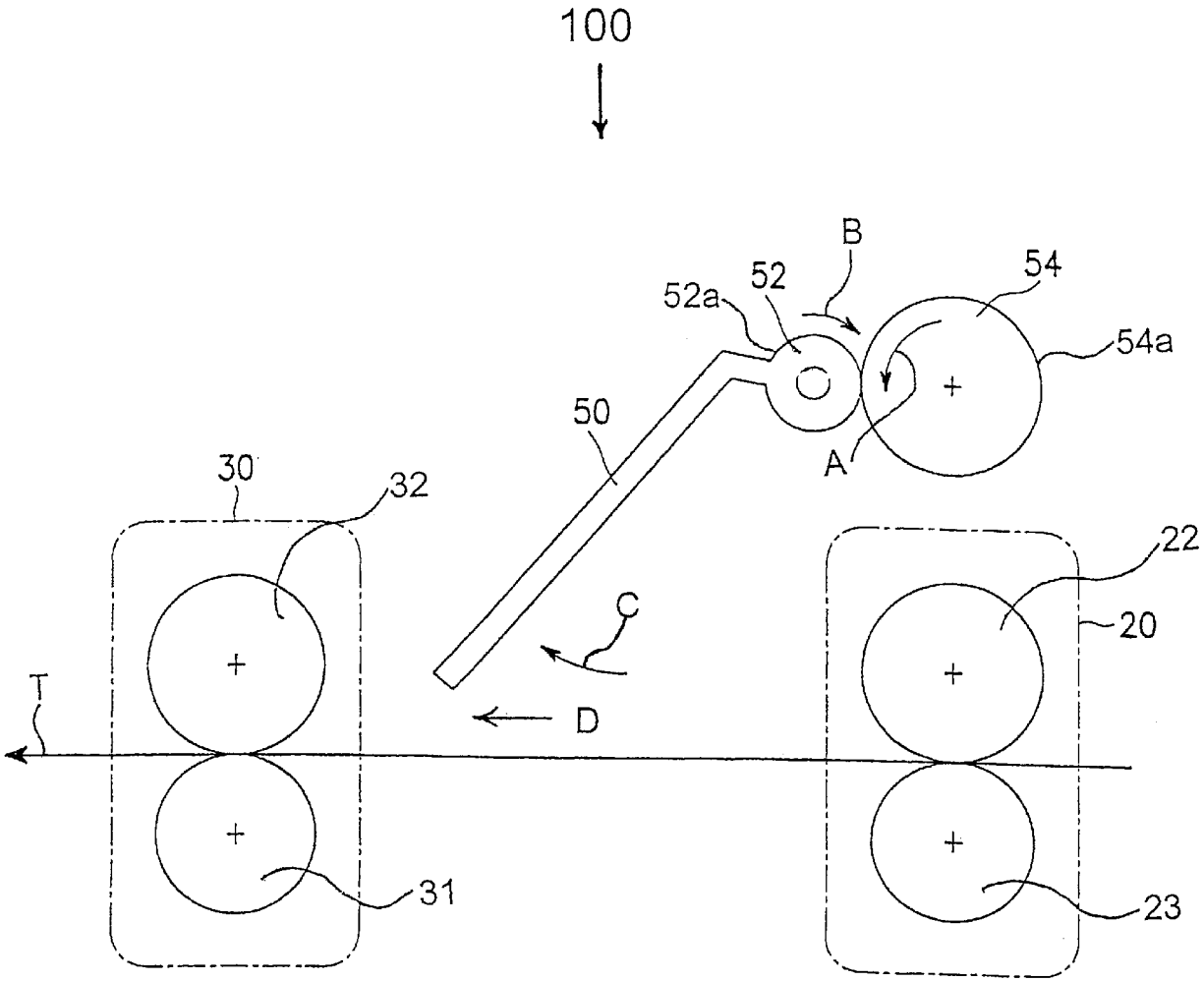
Figure 3C:
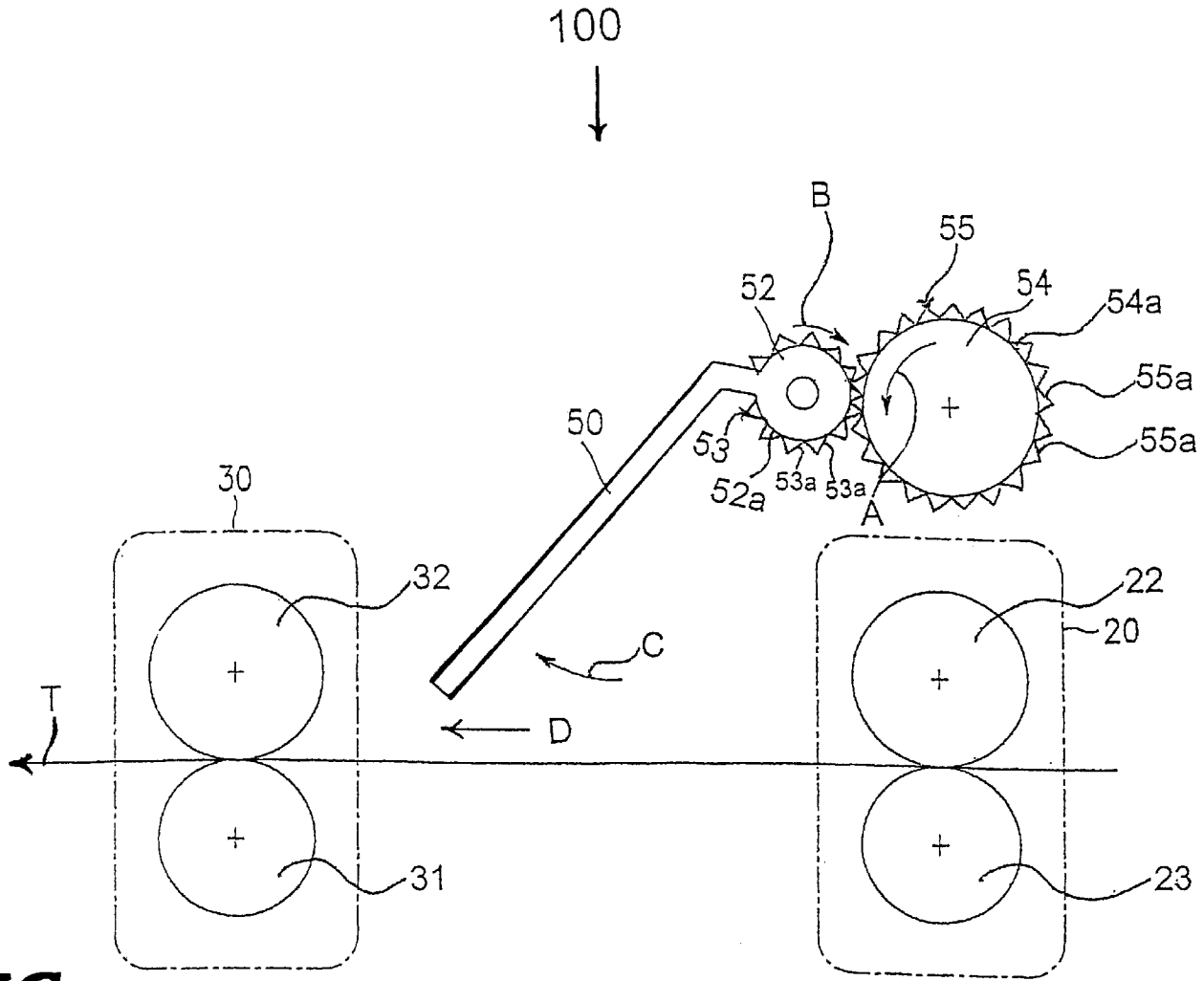

Referring now to FIGS. 3A through 3C, FIGS. 3A–3C are schematic views of the fixing heat shield device apparatus in the laser beam printer (LBP) 100 according to an embodiment of the present invention, referred to for describing the operation of the heat shield device. Referring to FIGS. 3A through 3C, an end of the heat shielding plate 50 is formed into a hinge 52 having a gear 53 formed on the outer circumferential surface 52*a* of hinge 52. The gear 53 of the hinge 52 is engaged with a gear 55 formed on the outer circumferential surface 54*a* of a clutch 54, with an example of the gear 53 and the gear 55 being illustrated in FIG. 3C. The gear 53 and the gear 55 each have gear teeth 53*a* and 55*a*, respectively, which engage with each other to provide movement for the heat shielding plate 50. Thus, when the clutch 54 is driven, the heat shielding plate 50 slightly moves around with the hinge 52.

Referring to and as shown in FIG. 3A, when the laser beam printer (LBP) printer 100 is inactive, the heat shielding plate 50 prevents heat transfer from the fixing device 30 by completely blocking the fixing device 30 from the developing device 20. This is called a closed state of the heat shielding plate 50. On the other hand, referring to FIGS. 3B and 3C, when the laser beam printer (LBP) printer 100 is active, the clutch 54 rotates in the direction of arrow A by a predetermined angle to rotate hinge 52 in the direction of arrow B, so that the heat shielding plate 50 slightly moves in a direction indicated by an arrow C and forms a gap indicated by an arrow D through which a printing medium, such as a paper sheet P, can pass, as shown in FIGS. 3B and 3C. This is called an open state of the heat shielding plate 50. Rotating the clutch 54 in a direction opposite to the direction of arrow A, rotates the hinge 52 in a direction opposite to the direction of arrow B to return the heat shielding plate 50 to the closed state of FIG. 3A. The closed and open states of the heat shielding plate 50 will be described in more detail with particular reference to FIG. 4.

Figure 4:
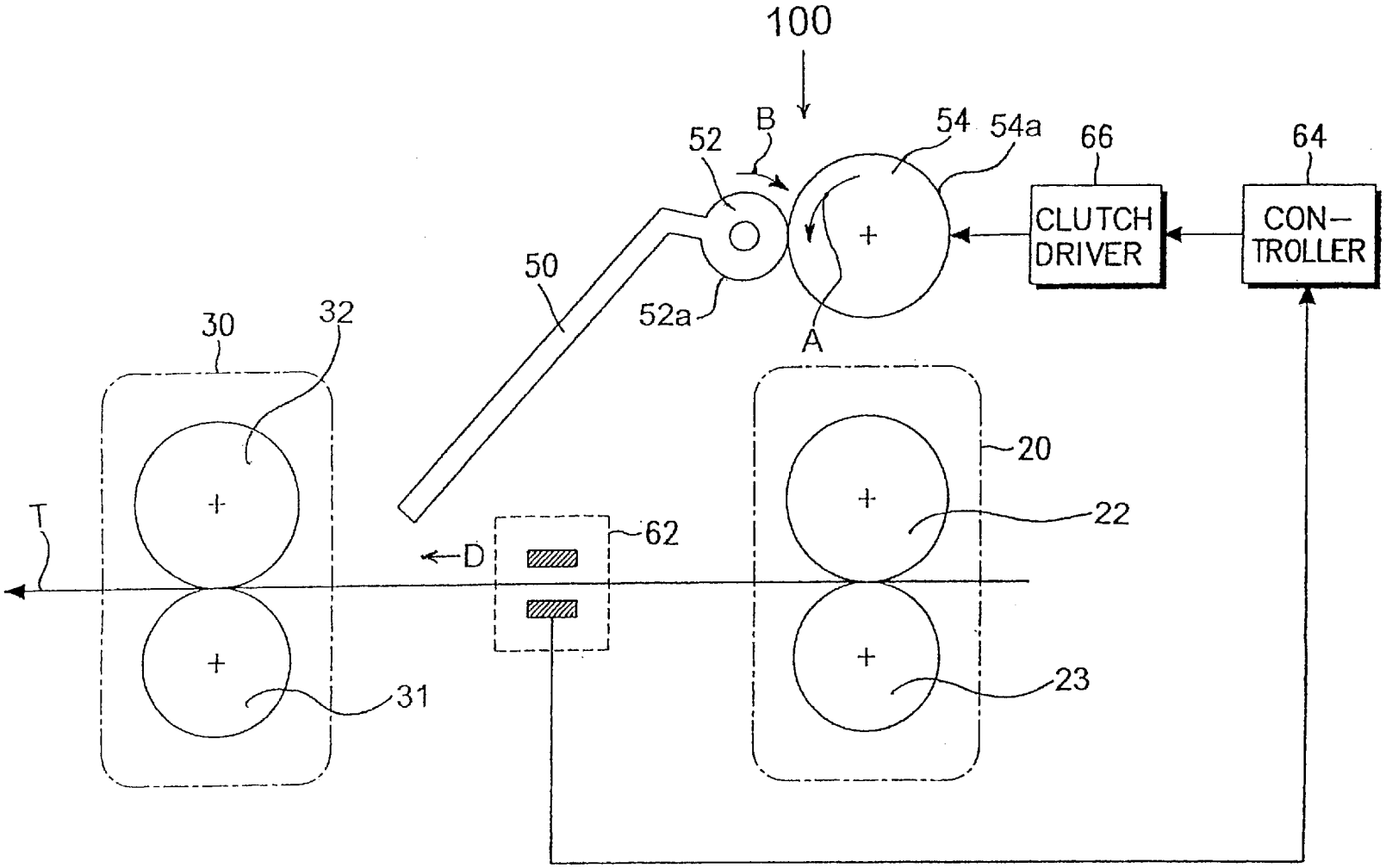
FIG. 4 is an overall schematic view of the fixing device heat shield apparatus according to the embodiment of FIG. 2 of the present invention.

Referring now to FIG. 4, FIG. 4 is an overall schematic view of the fixing device heat shield apparatus in the laser beam printer (LBP) printer 100 according to an embodiment of FIGS. 2 through 3C of the present invention. Referring to FIG. 4, the fixing device heat shield apparatus includes a clutch driver 66 for driving the clutch 54 in response to a control signal to open or close the heat shielding plate 50, a controller 64 for outputting the control signal to the clutch driver 66 in response to a sensing signal received from a printing medium sensor or a paper sheet sensor 62, and the printing medium sensor or sheet paper sensor 62 for sensing the presence or absence of a printing medium, such as a paper sheet P, passing through the developing device 20. The clutch driver 66 has a motor and a driving gear, for driving the clutch 54. The printing medium sensor or paper sheet sensor 62 can include a photodiode and is located in a printing medium travelling path or a paper sheet travelling path T for sensing the presence or absence of the printing medium, such as the paper sheet P. A sensor for sensing a paper jam can be used as the paper sheet sensor 62.

Continuing with reference of FIG. 4, the controller 64 outputs a control signal to the clutch driver 66 to cause the clutch driver 66 to drive the clutch 54 and open the heat shielding plate 50, when it is determined that the printing medium, such as the paper sheet P, is present from a sensing signal received from the printing medium sensor or paper sheet sensor 62. If the sensing signal indicates the absence of a printing medium, such as a paper sheet P, the controller 64 outputs a control signal to the clutch driver 66 to close the heat shielding plate 50. This controller 64 can be constituted of a central processing unit (CPU), for example, which can also provide overall control to the laser beam printer (LBP) printer 100.

In the absence of a printing medium, such as a paper sheet P, that is, when a printing operation is not performed, the heat shielding plate 50 is closed by blocking the printing medium travelling path or the paper sheet travelling path T to thereby prevent heat emitted from the fixing device 30 from being transferred to the developing device 20. In the presence of a printing medium, such as a paper sheet P, that is, when a printing operation is performed, the heat shielding plate 50 is opened with a gap D for passing the printing medium, such as the paper sheet P, while as much fixing heat as possible from fixing device 30 is blocked by the heat shielding plate 50.

As described above, the fixing device heat shield apparatus of the present invention includes a heat shielding plate 50 between the fixing device 30 and the developing device 20 to block fixing heat from the fixing device 30. Therefore, internal devices of the laser beam printer (LBP) printer 100 can be protected against the fixing heat from the fixing device 30, power consumption is reduced, and operational noise is prevented.

While the present invention has been described in detail with reference to specific embodiments, they are exemplary applications. For example, in an embodiment of the present invention, the opening and closing of the heat shielding plate 50 is controlled through the printing medium sensor or paper sheet sensor 62, but the controller 64 can control the heat shielding plate 50 to be opened in a printing mode for the laser beam printer (LBP) printer 100.

While there have been illustrated and described what are considered to be preferred embodiments of the present invention, it will be understood by those skilled in the art that various changes and modifications may be made, and equivalents may be substituted for elements thereof without departing from the true scope of the present intention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A fixing device heat shield apparatus in a printer, the printer having a fixing device and a developing device, comprising:

a plurality of air holes formed on a side surface of a body frame of the printer over the fixing device, the plurality of air holes for discharging heated air to the outside of the printer; and a heat shielding plate located between the fixing device and the developing device, the heat shielding plate selectively blocking heat transfer from the fixing device.

2. The fixing device heat shield apparatus of claim 1, further comprising a clutch having a gear formed on an outer circumferential surface of the clutch, and an end of the heat shielding plate including a hinge having a gear formed on an outer circumferential surface of the hinge, the gear of the hinge engaging with the gear of the clutch so that the heat shielding plate moves with the hinge when the clutch is driven.

3. The fixing device heat shield apparatus of claim 2, further comprised of the printer being a laser beam printer (LBP).

4. The fixing device heat shield apparatus of claim 3, further comprised of the heat shielding plate selectively blocking heat transfer from the fixing device to the developing device.

5. The fixing device heat shield apparatus of claim 2, further comprised of the heat shielding plate selectively blocking heat transfer from the fixing device to the developing device.

6. The fixing device heat shield apparatus of claim 1, further comprised of the printer being a laser beam printer (LBP).

7. The fixing device heat shield apparatus of claim 6, further comprised of the heat shielding plate selectively blocking heat transfer from the fixing device to the developing device.

8. The fixing device heat shield apparatus of claim 1, further comprised of the heat shielding plate selectively blocking heat transfer from the fixing device to the developing device.

9. A fixing device heat shield apparatus in a printer, the printer having a fixing device and a developing device, comprising:

a heat shielding plate located between the fixing device and the developing device, the heat shielding plate selectively blocking heat emitted from the fixing device and selectively closing and opening a printing medium travelling path between the fixing device and the developing device;

a heat shielding plate moving mechanism selectively moving the heat shielding plate to selectively open and close the printing medium travelling path in response to a control signal; and a controller selectively outputting the control signal to the heat shielding plate moving mechanism according to a printing operation mode for the printer.

10. The fixing device heat shield apparatus of claim 9, further comprised of the heat shielding plate moving mechanism comprising a clutch having a gear formed on an outer circumferential surface of the clutch, and an end of the heat shielding plate including a hinge having a gear formed on the outer circumferential surface of the hinge, the gear of the hinge engaging with the gear of the clutch so that the heat shielding plate moves with the hinge when the clutch is driven.

11. The fixing device heat shield apparatus of claim 10, further comprised of the printing medium travelling path being a paper sheet travelling path.

12. The fixing device heat shield apparatus of claim 10, further comprised of the printer being a laser beam printer (LBP).

13. The fixing device heat shield apparatus of claim 12, further comprised of the heat shielding plate selectively blocking heat transfer from the fixing device to the developing device.

14. The fixing device heat shield apparatus of claim 9, further comprised of the printing medium travelling path being a paper sheet travelling path.

15. The fixing device heat shield apparatus of claim 14, further comprised of the printer being a laser beam printer (LBP).

16. The fixing device heat shield apparatus of claim 15, further comprised of the heat shielding plate selectively blocking heat transfer from the fixing device to the developing device.

17. The fixing device heat shield apparatus of claim 9, further comprised of the printer being a laser beam printer (LBP).

18. The fixing device heat shield apparatus of claim 17, further comprised of the heat shielding plate selectively blocking heat transfer from the fixing device to the developing device.

19. The fixing device heat shield apparatus of claim 9, further comprised of the heat shielding plate selectively blocking heat transfer from the fixing device to the developing device.

20. The fixing device heat shield apparatus of claim 9, further comprising a plurality of air holes formed on a side surface of a body frame of the printer over the fixing device, the plurality of air holes for discharging heated air to the outside of the printer.

21. A fixing device heat shield apparatus in a printer, the printer having a fixing device and a developing device, comprising:

a heat shielding plate located between the fixing device and the developing device, the heat shielding plate selectively blocking heat emitted from the fixing device and selectively closing and opening a printing medium travelling path between the fixing device and the developing device;

a printing medium sensor located between the fixing device and the developing device, the printing medium sensor selectively sensing a presence and an absence of a printing medium on the printing medium travelling path and providing a sensing signal indicating one of the presence and the absence of the printing medium on the printing medium travelling path;

a heat shielding plate moving mechanism selectively moving the heat shielding plate to selectively open and close the printing medium travelling path in response to a control signal; and a controller selectively outputting the control signal to the heat shielding plate moving mechanism according to one of a printing operation mode for the printer and the sensing signal received from the printing medium sensor.

22. The fixing device heat shield apparatus of claim 21, further comprised of the heat shielding plate moving mechanism comprising a clutch having a gear formed on an outer circumferential surface of the clutch, and an end of the heat shielding plate including a hinge having a gear formed on the outer circumferential surface of the hinge, the gear of the hinge engaging with the gear of the clutch so that the heat shielding plate moves with the hinge when the clutch is driven.

23. The fixing device heat shield apparatus of claim 22, further comprised of the printing medium being a paper sheet and the printing medium travelling path being a paper sheet travelling path.

24. The fixing device heat shield apparatus of claim 23, further comprised of the printer being a laser beam printer (LBP).

25. The fixing device heat shield apparatus of claim 24, further comprised of the heat shielding plate selectively blocking heat transfer from the fixing device to the developing device.

26. The fixing device heat shield apparatus of claim 21, further comprised of the printer being a laser beam printer (LBP).

27. The fixing device heat shield apparatus of claim 26, further comprised of the heat shielding plate selectively blocking heat transfer from the fixing device to the developing device.

28. The fixing device heat shield apparatus of claim 21, further comprising a plurality of air holes formed on a side surface of a body frame of the printer over the fixing device, the plurality of air holes for discharging heated air to the outside of the printer.

29. The fixing device heat shield apparatus of claim 28, further comprised of the printer being a laser beam printer (LBP).

30. The fixing device heat shield apparatus of claim 29, further comprised of the heat shielding plate selectively blocking heat transfer from the fixing device to the developing device.

31. A method for forming a fixing device heat shield in a printer, comprising the steps of:

providing a plurality of air holes on a side surface of a body frame of the printer over a fixing device of the printer to discharge heated air to the outside of the printer; and providing a heat shielding plate between the fixing device and a developing device of the printer to selectively block heat transfer from the fixing device.

32. The method of claim 31, further comprised of the printer being a laser beam printer (LBP).

33. The method of claim 32, further comprised of the heat shielding plate selectively blocking heat transfer from the fixing device to the developing device.

34. The method of claim 31, further comprised of the heat shielding plate selectively blocking heat transfer from the fixing device to the developing device.

35. A method for forming a fixing device heat shield in a printer, comprising the steps of:

providing a heat shielding plate between a fixing device of the printer and a developing device of the printer to selectively block heat emitted from the fixing device;

moving selectively the heat shielding plate to selectively open and close a printing medium travelling path between the fixing device and the developing device in response to a control signal; and outputting from a controller for the printer the control signal to selectively move the heat shielding plate according to a printing operation mode for the printer.

36. The method of claim 35, further comprising the steps of:

sensing by a sensor one of a presence and an absence of a printing medium on the printing medium travelling path;

providing a sensing signal from the sensor indicating one of the presence and the absence of the printing medium on the printing medium travelling path; and outputting from the controller the control signal to selectively move the heat shielding plate according to one of the sensing signal received by the controller and the printing operation mode for the printer.

37. The method of claim 36, further comprised of the printing medium being a paper sheet and the printing medium travelling path being a paper sheet travelling path.

38. The method of claim 37, further comprised of the printer being a laser beam printer (LBP).

39. The method of claim 38, further comprised of the heat shielding plate selectively blocking heat transfer from the fixing device to the developing device.

40. The method of claim 36, further comprising the step of providing a plurality of air holes formed on a side surface of a body frame of the printer over the fixing device to discharge heated air to the outside of the printer.

41. The method of claim 40, further comprised of the printer being a laser beam printer (LBP).

42. The method of claim 36, further comprised of the printer being a laser beam printer (LBP).

43. The method of claim 42, further comprised of the heat shielding plate selectively blocking heat transfer from the fixing device to the developing device.

44. The method of claim 35, further comprised of the printing medium travelling path being a paper sheet travelling path.

45. The method of claim 44, further comprised of the printer being a laser beam printer (LBP).

46. The method of claim 35, further comprising the step of providing a plurality of air holes formed on a side surface of a body frame of the printer over the fixing device to discharge heated air to the outside of the printer.

47. The method of claim 46, further comprised of the printer being a laser beam printer (LBP).

48. The method of claim 47, further comprised of the printing medium travelling path being a paper sheet travelling path.

* * * * *